United States Patent [19]

Smith

[11] Patent Number: 4,883,297

[45] Date of Patent: Nov. 28, 1989

[54] POWER OPERATED DOOR GUARD

[76] Inventor: Daniel R. Smith, 32 W. Anapamu St., #351, Santa Barbara, Calif. 93101

[21] Appl. No.: 251,316

[22] Filed: Sep. 30, 1988

[51] Int. Cl.[4] ..... E05C 19/18

[52] U.S. Cl. ..... 292/339

[58] Field of Search ..... 292/262, 338, 339, DIG. 15

[56] References Cited

U.S. PATENT DOCUMENTS

| | | | |
|---|---|---|---|
| 2,709,615 | 5/1955 | Barnes, Jr. et al. | 292/339 |
| 2,898,140 | 8/1959 | Gislason | 292/342 |
| 3,124,382 | 3/1964 | Strother | 292/343 |
| 4,019,765 | 4/1977 | Nichola | 292/338 |
| 4,199,179 | 4/1980 | Curry | 292/338 |
| 4,456,291 | 6/1984 | Brogie | 292/338 |
| 4,483,558 | 11/1984 | Van Meter | 292/339 |
| 4,602,255 | 7/1986 | Kitagawa et al. | 340/825.69 |
| 4,607,253 | 8/1986 | Wooten et al. | 292/339 X |

*Primary Examiner*—Richard E. Moore

*Attorney, Agent, or Firm*—Harry W. Brelsford

[57] ABSTRACT

An inclined security brace for a door extends from the door knob to the floor and has telescoping parts that are extended and retracted by an electric motor. A horizontal arm keeps the brace in an inclined position when the brace is retracted. The motor is activated by radio controls having a circuit that controls the direction of retraction or extension. When the extension operation causes the brace to engage the floor an over load of the electronic motor occur and this over load is sensed by the circuit to stop the motor. When the retraction operation results in the telescoping parts reaching a mechanical stop the over load is again sensed by the circuit to stop the motor. Preferably the same transmitted signal is used for retraction and extension and a flip-flop in the circuit automatically alternates extension and retraction. The brace prevents entry to a room by pass keys.

10 Claims, 2 Drawing Sheets

Fig. 5
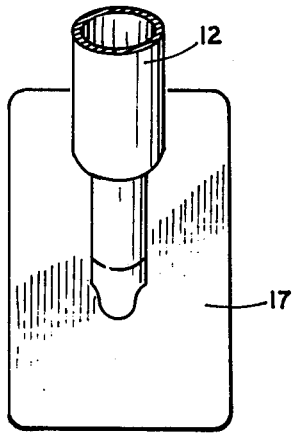
Fig. 6
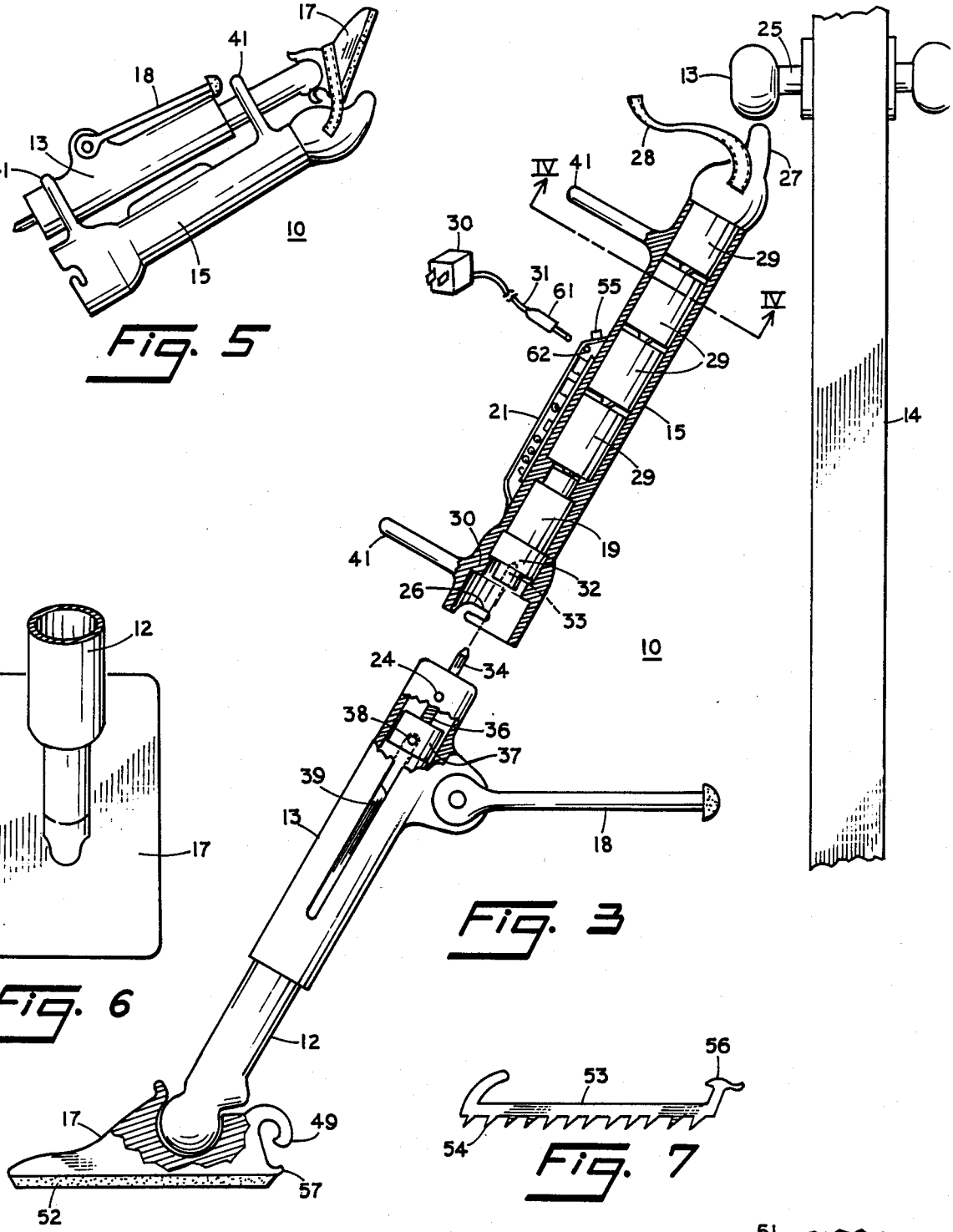
Fig. 3
Fig. 7
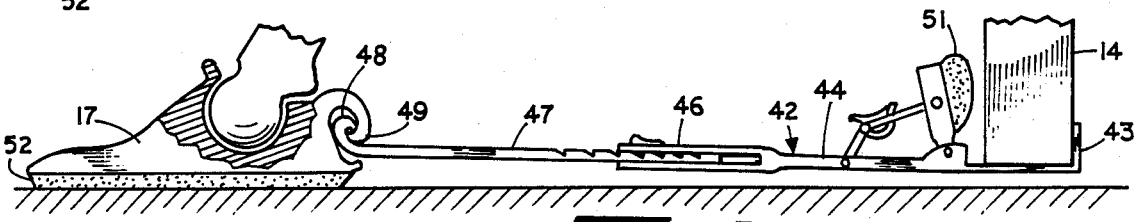
Fig. 8

POWER OPERATED DOOR GUARD

This invention relates to security braces for doors to prevent unauthorized opening of the door, and has particular reference to a power operated door brace and a remotely controlled door brace.

BACKGROUND OF THE INVENTION

Many types of security devices for door have been devised to prevent unauthorized entry of rooms especially in hotels and motels. Throw bolts are commonly used and those operated only from the inside of the room are preferred. Many persons distrust the strength of throw bolts and braces from the floor to doorknobs have been devised. These braces extend at an angle from the floor to the doorknob and are sometimes extendable in length to get a firm grip on the floor as the upper end presses against the doorknob. These devices are generally operable only from the inside of the room and cannot be put in place on the inside of the door when the occupant leaves the room. The room, is then available for unauthorized entry by anyone with a key to the lock.

BRIEF SUMMARY OF INVENTION

I have devised a power operated doorknob security brace, that is operable not only from inside the room but from the outside as well. I provide a brace that is extendable or retractable by power. Further I provide a remote control for the power operated brace so that it can be extended after the occupant leaves the room to lock the door and can be retracted from outside the room to permit opening of the door. I prefer a radio remote control and the circuits used for remote arming and disarming have proved to be satisfactory.

BRIEF DESCRIPTION OF THE DRAWINGS

In the drawings forming an integral part of this specification:

FIG. 3 is an elevation view, partly in section showing the brace of FIG. 1 separated into two parts for convenient storage or transportation.

FIG. 5 is a diagram on a smaller scale of the two brace portions together by the snap brackets of FIG. 4.

FIG. 6 is a top view or plan view of the foot of FIG. 3 and a portion of the brace.

FIG. 7 is an elevation view of a flexible foot shoe with projecting to engage carpet in a room.

FIG. 8 is an elevation view of an attachment that is slipped under a door when it is open and upon door closing is hooked to the that the foot cannot be dislodged by persons push rod under the door when the door is closed.

DETAILED DESCRIPTION OF THE PREFERRED EMBODIMENT

Figure 1:
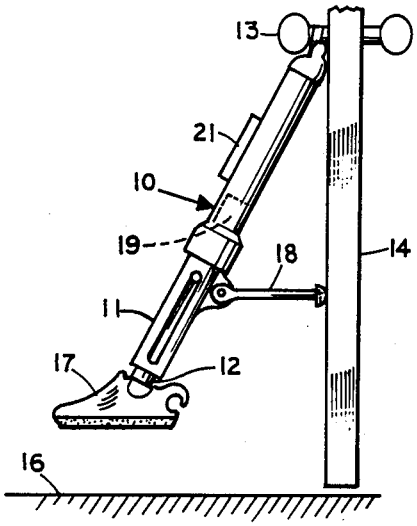
FIG. 1 is a diagram of a presently preferred embodiment of my invention showing a brace secured to the doorknob and retracting to lift the brace foot from the floor.

Referring to FIG. 1 there is illustrated a brace 10 embodying my invention having an outer tube 11 within which reciprocates an inner tube 12. The brace 10 is secured at its upper end to a doorknob 13 on a door 14 which swings to the left to open. The door 14 is the entrance to a room (not shown) which has a floor 16.

Disposed on the bottom end of the brace 10 is a pivoted foot 17. Projecting horizontally from the brace is a pivot arm 18 normally held in a horizontal position. This arm 18 rests against the door 14 to hold the brace 10 at an angle to the door, which angle may be 30 degrees or greater for best results. The brace 10 is shown in its retracted position in FIG. 1 which permits the door 14 to be freely opened or closed.

Figure 2:
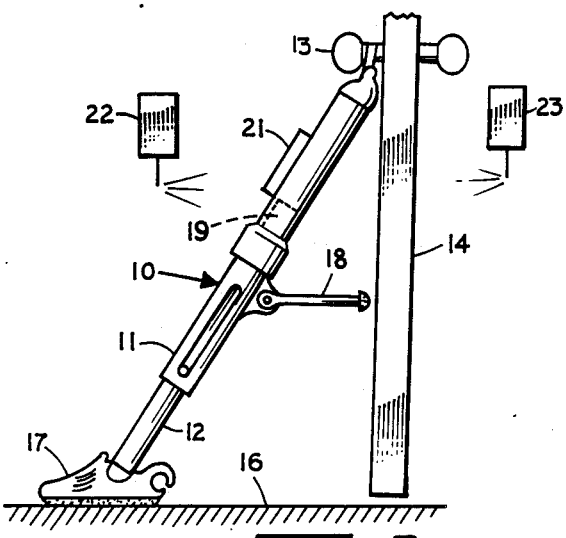
FIG. 2 is a diagram of the devise of FIG. 1 with the brace extended so that the foot engages the floor so that the upper end presses against the doorknob, and showing remote control radio transmitters.

Illustrated in FIG. 2 is the brace 10 in its extended condition wherein the foot 17 engages the floor 16 and prevents 14 from swinging to the left. The extension is accomplished by an internal motor 19 supplied with electrical current from any suitable source, such as internal batteries. The motor 19 is controlled by a radio receiver and associated electronics 21 which may be an off-the shelf arming and disarming circuits. Coded radio waves are sent directly to the radio receiver 21 by a hand held transmitter 22 and radio waves are transmitted through the door 14 by a hand held transmitter 23. The transmitters are preferably also off-the-shelf remote arming and disarming transmitters. When the code supplied by the transmitters is identical to the code recognized by the receiver 21, then the brace 10 will extend or retract depending upon the state of a flip-flop in the electronics 21. The flip-flop in the circuit permits the use of the same radio signal to extend or retract the brace 10, although separate extend and retract signals could be used.

While any suitable transmitting medium can be used, such as ultra sonic sound waves, I prefer radio waves because the transmitters and receivers are readily and inexpensively available.

Referring to FIG. 3, there it will be noted that the exterior tube 13 and its inner telescoping tube 12 may be separated from an upper tubular member 15. This connector for separation (and connection) of the tube 13 to the tube 15 may be of any suitable type and there is shown a bayonet connection wherein pins 24 fit in curved slots 26. A simple twisting action connects or disconnects the upper part 15 from the lower part 13. The upper end of part 13 abuts a thrust ring 30 which insulates the motor 19 and gear box 33 against compressive forces.

Referring still to FIG. 3, the upper tube 15 has on its upper end a yoke 27 to which is attached a strip of fabric 28 that passes over the shaft 25 of the inner doorknob 13 to hold the upper end of brace 10 to the door 14. This fabric strip 28 may have hooks or loops on one surface that engages loops or hooks on a piece (not shown) on the far side of the yoke 27. Such fabrics are sold under the trademark of Velcro and other names.

The yoke 27 is part of a cap on the tube 15 in which are disposed a plurality of batteries 29 which are preferably rechargeable and recharging can be done in place by an optional recharging unit 30 which can be plugged into any conventional outlet. The recharging unit 30 may include a step down transformer connected by a cord 31 to a plug 61 fitting into a socket 62 on upper tube 15. This recharging is especially useful when the brace 10 is left in place for a matter of weeks or months and the smaller constant drain might otherwise deplete the batteries and cause the door to remain permanently locked.

Referring still to FIG. 3, the motor 19 is connected to a gear reduction unit 32 preferably an off-the-shelf planetary gear unit which has a recess 33 to receive a splined shaft 34 projecting from the lower tube 13. The splined shaft is rotated by the reduction gears 32 and it is connected to a threaded shaft 36 which threads into a non-rotatable nut 37 secured to the upper end of the inner tube 12. The inner tube 12 (and the nut 37) are prevented from rotating by a pin 38 projecting from the inner tube 12 into a longitudinal slot 39 in the outer tube 13.

Figure 4:
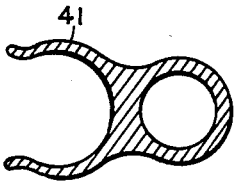
FIG. 4 is a sectional view along the line IV—IV of FIG. 3 showing one of the two snap brackets for holding the bottom portion of brace to the upper portion.

Illustrated in FIG. 5 is a break down of the brace 10 wherein the lower tubes 13 and 12 and the foot 17 are held to the tube 15 by a pair of snap brackets 41 shown in detail in FIG. 4.

Referring now to FIG. 8 there is illustrated an attachment 42 having a channel 43 that slips under the door 14 when it is open and which has an extension 44 terminating in a ratchet adjustment 46. To the left of the adjustment 46 is a shank 47 terminating in a hook 48 that engages a complimentary hook 49 in the foot 17. The two hooks are engaged when the attachment 42 is generally vertical and thereafter the attachment is rotated to a horizontal position and slipped under the bottom of the door 14 when it is open. The door is then closed and the adjustment 46 is tightened against the restraint of the horizontal arm 18. The purpose of attachment 42 is to prevent persons in high risk areas from inserting rods under the door to push the foot 17 inwardly to release the brace 10. A soft rubber bumper 51 can be moved against the inside of the door 14 to hold the channel 43 in the position shown so that it will not drag as the door 14 swings on its hinges.

The device can be used in rooms with hard wood, concrete or other floors devoid of carpeting. For this purpose the foot 17 has a layer of soft rubber or plastic 52 to grip the floor regardless of minor unevenness. For carpeted floors a tooth shoe 53 is snapped over the foot 17 and this is shown in FIG. 7 wherein teeth 54 point to the left and the shoe is held by an integral hook 56 engaging a projection 57 on the foot.

OPERATION

The device will normally be transported in a suitcase or other containers in the form shown in FIG. 5. The parts are then disengaged and aligned as shown in FIG. 3. The lower tube 13 is inserted within the lower end of the tube 15 so that the splined shaft fits in the gear box recess 33. A relative rotation of tubes 13 and 15 engages the slots 26 and pins 24 to fasten the two together. The Velcro strap 28 is next passed over the shaft 25 of doorknob 13 to hold the brace 10 to the door 14. The arm 18 is rotated to the position shown in FIG. 3 to hold the brace 10 at an angle with respect to the door 14.

The operator next presses an on-off switch 55 at the upper end of the radio receiver 21 (FIG. 3). The device is now ready for radio control.

Shown in FIG. 1 is the device in retracted condition. If the occupant of the room desires to brace the door against intruders, he operates the radio transmitter 22 of FIG. 2 resulting in an "extend" signal which is transmitted through the air to the receiver 21. The electric motor 19 then uses current from batteries 29 (FIG. 3) to rotate the threaded shaft 36 within non-rotatable nut 37 to extend the brace 10 to the condition shown in FIG. 2. An automatic limit stop (shown in FIG. 9) stops the motor when a sensor detects an overload condition of current at the limit of extension when the foot 17 engages the floor, or retraction when the pin 38 reaches the upper end of slot 39.

If now the occupant desires to leave the room he operates radio transmitter 22 resulting in a "retract" signal whereupon the receiver 21 causes the foot 17 to be lifted as shown in FIG. 1. He next opens the door 14 by swinging it to the left and proceeds through the doorway and closes the door with the brace hanging on it as shown in FIG. 1. He next operates a radio transmitter 23 (which may be the same transmitter 22) resulting in an "extend" signal whereupon the foot 17 again engages the floor 16 to lock the door. When he returns and desires to open the door he merely operates transmitter 23 resulting in a "retract" signal to the receiver 21 whereupon the foot 17 is retracted to the position shown in FIG. 1. The person then enters his room.

Referring to FIG. 8 the extension 44 and shank 47 can be described as telescoping members and the ratchet adjustment 46 constitutes means for locking these telescoping members at any desired over all length.

Figure 9:
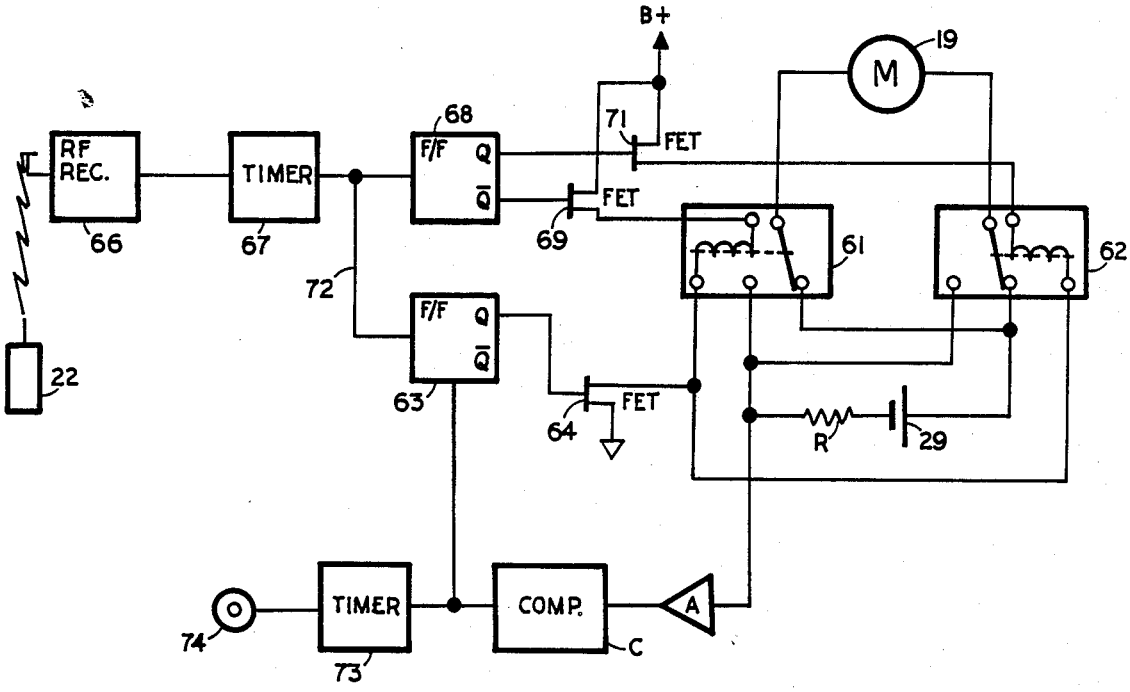
FIG. 9 is a schematic circuit for the device.

Referring to FIG. 9 there is illustrated a schematic diagram of a circuit for carrying out the radio commands. In the upper right the motor 19 is shown as well as motor battery 29. The battery 29 is connected to the motor 19 through a pair of relays 61 and 62 that determine the direction of rotation of the motor 19. The relays are sown in their non-energized positions. As shown in FIG. 9 the motor is in the OFF mode because the two relays are connected to a common side of the battery 29. The battery is connected to the motor through a series resistor R. If now a radio signal is received and recognize by the circuit, one of relays 61 and 62 will be energized and the relay armature of the energized relay will swing to the left completing a circuit from the battery 29, through the resistors R and through the motor 19.

If now the motor has fully extended or retracted the member 12 (FIG. 3), the movement will be mechanically stopped and as the motor 19 tries to overcome the stop, the current from battery 29 will drastically increase. This creates a voltage change across the series resistor R which is amplified by amplifier A and this amplified signal is fed to a comparator C which compares the voltage to an internal standard. When the standard is exceeded the comparator sends a signal to a flip-flop 63 which is the on-off flip-flop. When the signal from the comparator C is high, flip-flop 63 is reset turning off (opening) FET switch 64 which opens the circuit to the relay coils, allowing the relays to assume the position shown, and stopping motor 19. Switch 64 is normally open and is closed only during the 7 to 21 second period required to extend or retract member 12.

If now a radio signal is turned on (FIG. 2) from transmitters 22 or 23, its code can be recognized by a receiver 66 which sends a signal to a timer 67 which is turned on for a selected time period and it will refuse any new signal during that time period. I presently prefer a time period of 25 seconds because the inner tube 12 can be fully extended or retracted in 21 seconds. The signal from receiver 66 is transmitted through the timer 67 to a flip-flop circuit 68 connected to two switches FET 69 and FET 71 connected respectively to the relays 61 and 62. One of switched 69 or 71 is normally closed. The flip-flop circuit 68 will open the switch 69 or 71 which was previously closed and close the switch 69 or 71 which was previously open.

Therefore if the prior operation of the device was to extend the inner tube 12, then flip-flop 68 will cause the next operation to retract tube 12, and vice versa. This is done when one of switches 69 or 71 closes the circuit to the respective relay 61 or 62. This causes the affected relay to switch to the other terminal from that shown in FIG. 9, thus completing a circuit from the battery 29 to the motor 19. Simultaneously with the operation of flip-flop 68, the signal from the receiver 66 is transmitted through the timer and by a branch wire 72 to the on-off flip-flop 63. This is a high input and causes switch 64 to close. This closes a current to both relays 61 and 62 and energizes one or the other of relays 61 and 62, causing the motor to rotate in one direction or the other to extend or retract telescoping member 12. This direction of rotation is controlled by switches 69 or 71 as previously explained.

Referring to the lower left part of FIG. 9, connected to comparator C is a timer 73 which operates an audio sounder 74 for a few seconds to signal the completion of the extension or retraction movement.

I have described my invention with respect to my presently preferred embodiment as required by the patent statutes. It will be obvious to those skilled in the art that various modifications and variation can be made. I include all variations and modifications that come within the true spirit and scope of my invention within the scope of the following claims.

I claim:

1. A security brace for doors having doorknobs or the like for rooms having floors comprising:

(a) a telescoping brace having relatively moveable parts;

(b) means attached to one end of the brace for holding the brace to a doorknob;

(c) a foot attached to the other end of the brace for engaging a floor;

(d) thread and nut means for extending and retracting the brace;

(e) an electric motor connected to one of said thread and nut to rotate one with respect to the other;

(f) an arm extending from the brace to contact a door to hold the brace at an angle to the door.

2. A security brace as defined in claim 1 wherein there is added:

(g) control means for the electric motor responsive to signals projected through the air to extend and retract the brace.

3. A security brace as defined in claim 1 wherein batteries are secured to the brace and are selectively connected to the electric motor to extend and retract the brace.

4. A security brace for doors having doorknobs or the like for rooms having floors comprising:

(a) a telescoping brace having relatively moveable parts;

(b) means attached to one end of the brace for holding the brace to a doorknob;

(c) a foot attached to the other end of the brace for engaging a floor;

(d) thread and nut means for extending and retracting the brace;

(e) an electric motor connected to one of said thread and nut to rotate one with respect to the other;

(f) control means for the electric motor responsive to signals projected through the air to extend and retract the brace.

5. A security brace for doors having doorknobs or the like for rooms having a floor comprising:

(a) a brace that is extensible and retractable;

(b) power means connected to said brace for extending and retracting the brace;

(c) means for engaging a doorknob on one end of the brace; and (d) means for engaging the floor on the other end of the brace.

6. A security brace as set forth in claim 5 wherein there is added:

(e) means securing the brace to the door;

(f) and an arm projecting from the brace to engage a door to hold the brace at an angle to the door.

7. A security brace as set forth in claim 5 wherein there is added control means for the power means responsive to signals projected through air to retract the brace from the outside of the door to thereby permit entry.

8. A security brace as set forth in claim 5 wherein the brace has two parts that can be disconnected and one part has snap clips to hold the other part to it for transport.

9. For use with security door braces having an upper end that engages a door and having a lower end that engages the floor, an attachment for connection to the lower end comprising, a channel member that can be slipped under the bottom of an open door; a telescoping arm having one end connectable to the lower end of the brace and having the other end connected to the channel member; and means for locking the telescoping arm, to thereby prevent unwanted movement of the lower end of the brace away from the door.

10. A security brace for doors as set forth in claim 4, wherein item f includes means for alternating the extension and retraction of the brace responsive to successive signals projected through the air.

* * * * *